United States Patent [19]

Bolasny

[11] 4,069,665

[45] Jan. 24, 1978

[54] GAS IONIZING APPARATUS FOR IMPROVING THE OPERATION OF AN INTERNAL COMBUSTION ENGINE

[75] Inventor: Robert E. Bolasny, Boulder, Colo.

[73] Assignee: Scientific Enterprises, Inc., Broomfield, Colo.

[21] Appl. No.: 634,638

[22] Filed: Nov. 24, 1975

Related U.S. Application Data

[62] Division of Ser. No. 384,464, Aug. 1, 1973, Pat. No. 3,943,407.

[51] Int. Cl.[2] ..... F02B 75/10

[52] U.S. Cl. ..... 60/275; 123/119 E; 204/164; 250/426; 250/531; 361/231

[58] Field of Search ..... 60/303, 275; 123/119 E; 317/262 AE; 204/164; 250/532, 531, 537, 426

[56] References Cited

U.S. PATENT DOCUMENTS

| | | | |
|---|---|---|---|
| 1,614,234 | 1/1927 | Trairun | 123/119 E |
| 1,771,626 | 7/1930 | Hamilton | 123/119 E |
| 1,872,065 | 8/1932 | Duffendack | 204/164 |
| 1,873,746 | 8/1932 | English | 123/119 E |
| 2,005,249 | 6/1935 | Tietig | 60/303 |
| 2,060,842 | 11/1936 | Yaglou | 317/262 AE |
| 3,091,920 | 6/1963 | Matvay | 60/275 |
| 3,157,479 | 11/1964 | Boles | 60/275 |
| 3,317,790 | 5/1967 | Whitby | 250/426 |
| 3,476,095 | 11/1969 | Laubarede | 123/119 E |
| 3,841,824 | 10/1974 | Bethel | 60/275 |
| 3,846,637 | 11/1974 | Gettinger | 60/275 |
| 3,882,677 | 5/1975 | Eknayan | 60/303 |

FOREIGN PATENT DOCUMENTS

| | | | |
|---|---|---|---|
| 959,669 | 10/1949 | France | 123/119 E |

*Primary Examiner*—Douglas Hart
*Attorney, Agent, or Firm*—Ancel W. Lewis, Jr.

[57] ABSTRACT

A method and apparatus for producing ions wherein an ion generator produces periodic pulses of electric energy of a single polarity for some applications and alternating positive and negative polarities for other applications. A plurality of the electric pulses are limited in amplitude by a substantially sinusoidal half-wave envelope and the positive and negative pulses are preferably of different amplitudes. The ground electrode is arranged about and upstream and downstream of the ionizing electrode to provide a highly effective electric field substantially normal to the gas flow. A heater heats the gas to increase ionization. An ultrasonic sound wave generator pulses the gas with sound waves prior to, during or after ionization of the gas to group the ions of a like charge in distinct pressure wave fronts or distinct areas so as to reduce recombination of ions thereby making more ions available per volume and also increasing the total energy of the ions produced. Multiple sound wave generators increase the energy of the base frequency or selected harmonics. An inlet passage to the generator of a selected length increases the energy. A discharge passage of a selected length reinforces and/or eliminates selected harmonics. A discharge nozzle with angularly inclined and outwardly enlarged venturis cool the heated ionized gas.

7 Claims, 26 Drawing Figures

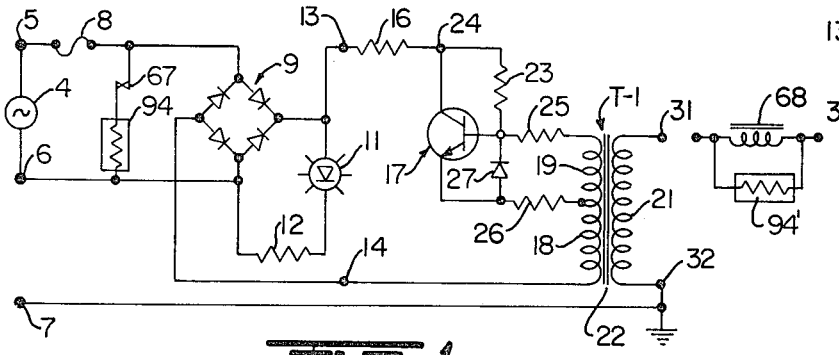
FIG. 1
FIG. 1A
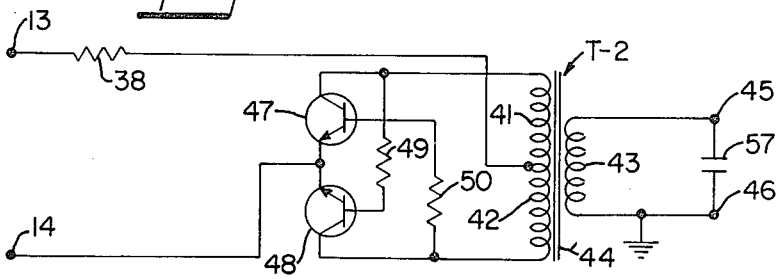
FIG. 3
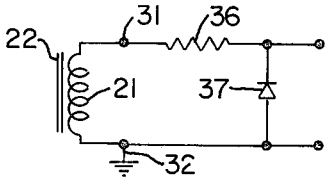
FIG. 1B
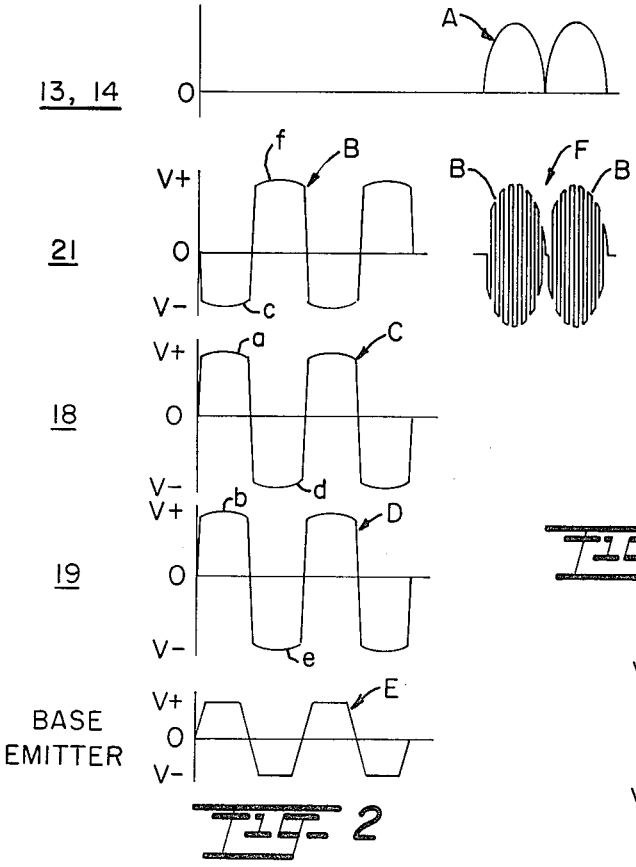
FIG. 2
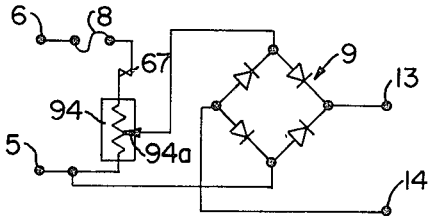
FIG. 6
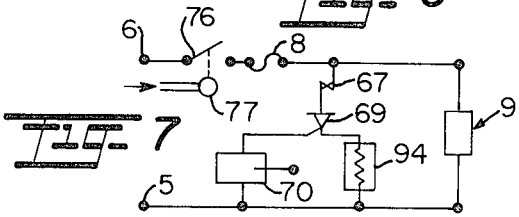
FIG. 7
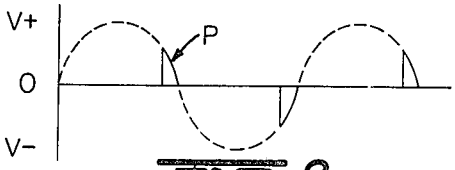
FIG. 8

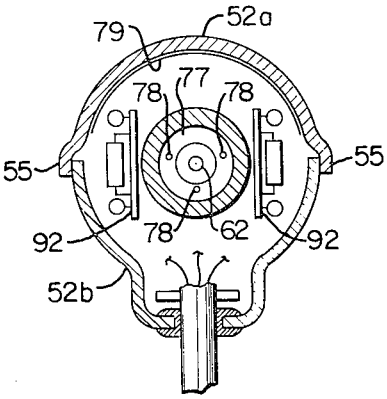
FIG. 5
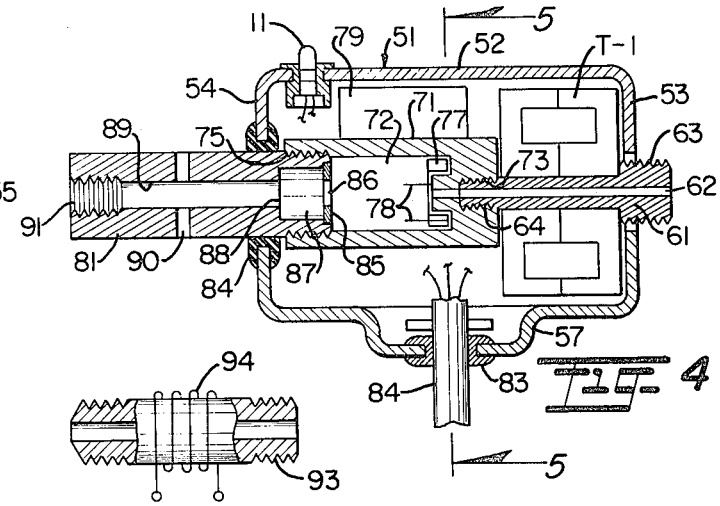
FIG. 4
FIG. 4A
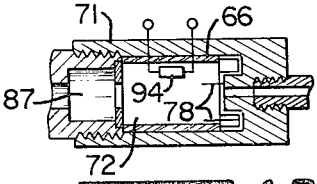
FIG. 4B
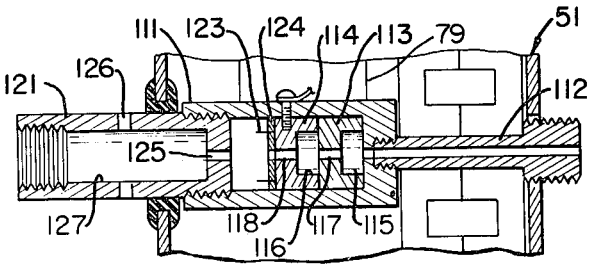
FIG. 10
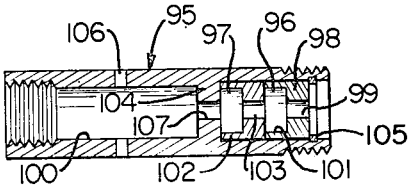
FIG. 9
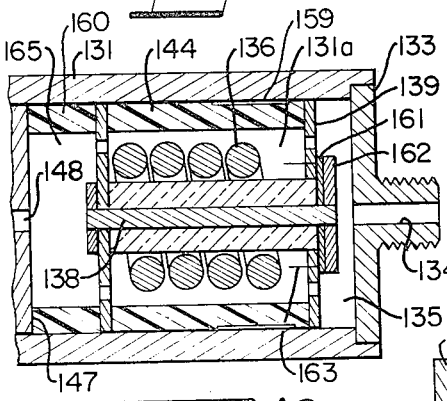
FIG. 12
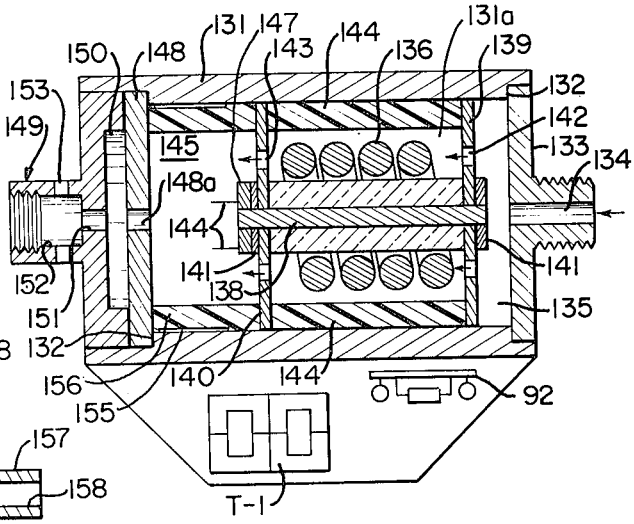
FIG. 11
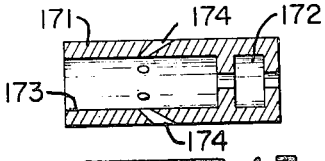
FIG. 13
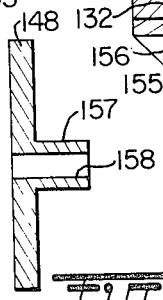
FIG. 11A

GAS IONIZING APPARATUS FOR IMPROVING THE OPERATION OF AN INTERNAL COMBUSTION ENGINE

This is a division of application Ser. No. 384,464, filed Aug. 1, 1973, and now U.S. Pat. No. 3,943,407.

BACKGROUND OF THE INVENTION

1. Field

This invention in general relates to the ionization of gases and more particularly to an improved method and apparatus for producing greater quantities of usable ions and ions at greater energy levels with a minimum of ozone.

2. Description of the Prior Art

In U.S. Pat. No. 3,711,743 there is described a novel method and apparatus for generating ions in an efficient manner with a minimum of ozone utilizing the application of periodic, oscillatory positive and negative pulses of electric energy. In a later filed patent application entitled "Method and Apparatus for Producing Ions at Ultrasonic Frequencies " now U.S. Pat. No. 3,878,469, issued Apr. 15, 1975, there is described a combination of gas ionizing and ultrasonic sound wave pulsing of the gas using a resonant-type ultrasonic cavity which increases the energy levels of the ions by increasing the velocity thereof and groups ions of like charges in distinct wave fronts which has been found highly effective for a wide range of applications including the cleaning of particulate from a charged surface, spray painting and improving the efficiency of and removing discharge pollutants from internal combustion engines.

Accordingly, it is a general object of the present invention to provide an improved method and apparatus for generating greater quantities of ions at higher energy levels.

Another object of this invention is to provide improved electric ion generator circuits characterized by producing continuous oscillations of positive and negative pulses of electric energy in an envelope with no significant time delay between pulses or between cycles.

Another object of the present invention is to provide a novel and improved resonant cavity ultrasonic generator structure for use in enhancing the effectiveness of the ions produced in a gas.

Still a further object of the present invention is to provide a novel method and apparatus for increasing the ionization of a gas by the heating of the gas in which the ions are generated.

Yet another object of the present invention is to provide a novel method and apparatus for increasing the energy in a stream of gas by passing it through a discharge nozzle of a selected length in relation to the frequency of the electric energy.

Still another object of the present invention is to provide a novel method and apparatus for generating ions having particular effectiveness in use as a non-contact cleaning tool, increasing the efficiency of an internal combustion engine, reduction of pollutants from exhaust gases and in improving the results in spray painting.

SUMMARY OF THE INVENTION

In accordance with the present invention, there is provided an electric circuit which produces periodic pulses of electric energy having a plurality of the pulses limited in amplitude by a sinusoidal envelope, the pulses applied to an ionizing electrode spaced from a ground electrode. A heating element heats the gas to increase ionization. The ground electrode is spaced outwardly from as well as extending upstream and downstream from the ionizing point so that the flux lines move normal to the stream of gas. Multiple resonant cavity ultrasonic generators are arranged in series to amplify the base frequency or amplify selected harmonics for increased energy. The ionization of a gas with particles improves spray painting and the application of the high energy ions to the gas passing into the induction pipe of a carburetor increases engine efficiency and its application to the exhaust gas passing from the manifold reduces pollution.

DESCRIPTION OF THE DRAWINGS

Other objects, advantages, and capabilities of the present invention will become more apparent as the description proceeds taken in conjunction with the accompanying drawings in which:

FIG. 1 is schematic electric circuit diagram for an electric ion generator in accordance with the present invention;

FIG. 1A is a voltage regulator circuit which may be used in the circuit diagram of FIG. 1 as an alternative to a series resistor;

FIG. 1B is a rectifier circuit adapted to cut off one of the periodic pulses to provide only one type of ion from the circuit of FIG. 1;

FIG. 2 is an illustration representing waveforms produced by the electric ion generator of FIG. 1;

FIG. 3 is an alternative schematic electric circuit diagram for an electric ion generator in accordance with the present invention;

FIG. 4 is a vertical sectional view of a gun-type ion generator used in conjunction with the circuits of FIG. 1 through 3;

FIG. 4A is a vertical sectional view of a heater attachment for heating the gas flowing into the ion generator of FIG. 4;

FIG. 4B is a vertical sectional view of an alternative form of ion generator with a heater in the ionizing chamber;

FIG. 5 is a sectional view taken along lines 5-5 of FIG. 4;

FIG. 6 is a schematic electric circuit diagram showing an alternative manner of connecting the heater in the ion generator from that shown in FIG. 1;

FIG. 7 is a schematic electric circuit diagram showing a control arrangement for the electric heater;

FIG. 8 is a waveform illustrating the control of the power applied to the heater by the circuit of FIG. 7;

FIG. 9 is a vertical sectional view of an alternative form of output nozzle for the ion generator shown in FIG. 4 having multiple ultrasonic sound wave generator units;

FIG. 10 is a vertical sectional view of a portion of another form of ion generator having the ultrasonic energy applied by two cascaded cavities to the stream of gas prior to ionization;

FIG. 11 is a vertical sectional view of another form of ion generator with internal heater for heating the stream of gas prior to ionization thereof;

FIG. 11A is a vertical sectional view of a tuned inlet for the resonant cavity of FIG. 11.

FIG. 12 is a vertical sectional view of another form of ion generator apparatus with the heating and ionization taking place in the same chamber;

FIG. 13 is a vertical sectional view of an alternative form of nozzle member with angularly inclined and outwardly enlarged venturis;

DESCRIPTION OF THE PREFERRED EMBODIMENTS

Figure 14:
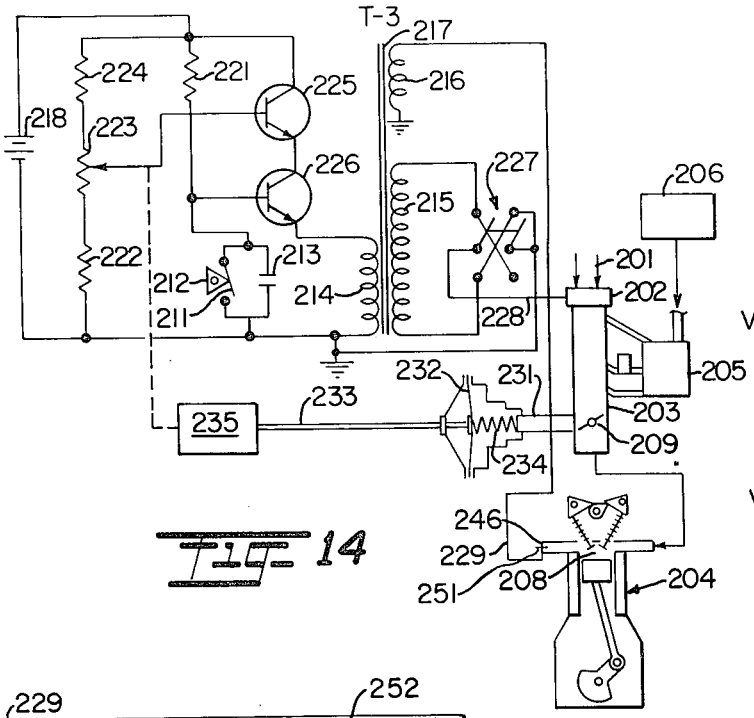
FIG. 14 is a schematic diagram of a system for ionizing both the intake gas and exhaust gas of an internal combustion engine in accordance with the present invention.

The electric circuit forming a part of the ion generator shown in FIG. 1 has power input terminals 5, 6, and 7 to which typically a 115 volt, sinusoidal AC line power represented by a signal generator 4 is applied. The line power is applied across terminals 5 and 6 and terminal 7 is grounded. A fuse 8 is connected in the line of terminal 5 as a protective device protecting the circuit components against short circuits. The power applied to input terminals 5 and 6 is applied to a full wave bridge rectifier circuit 9 comprised of four diodes electrically connected in a bridge in a conventional manner. This bridge rectifier circuit 9 converts the convention 60 cycle sinusoidal line power input to a pulsating sinusoidal half-wave voltage having a frequency of 120 cycles or pulses per second with a full cycle of the waveform designated A and illustrated in FIG. 2. A light-emitting diode 11 is connected in series with a voltage-dropping resistor 12 which is then connected across one rectifier of the bridge rectifier circuit 9 so that the light-emitting diode 11 indicates that the circuit has an input voltage being applied to it. The output terminals of the bridge rectifier circuit 11 are designated 13 and 14. A resistor 16 is connected in the line between terminal 13 and an input terminal 24 of the oscillator portion of the circuit described hereinafter which resistor functions as a protective device should a short occur at the output of the ion generator circuit.

The oscillator portion of the ion generator circuit of FIG. 1 includes a NPN transistor 17 having emitter, base and collector electrodes which in effect functions to alternately couple and uncouple the electric power from the bridge rectifier circuit 11 to the transformer T-1. The transformer T-1 has a primary winding 18, a feedback winding 19 and a secondary winding 21, the windings 18, 19 and 21 being wrapped on a common core 22. A voltage divider includes a resistor 23 connected across the base and collector electrodes of the transistor 17 with the collector electrode being connected to the input terminal 24 which in turn is connected to the end of resistor 16 opposite terminal 13 together with a resistor 25 connected between the base electrode and feedback winding 19. A series circuit including a resistor 25, feedback winding 19 and resistor 26 are connected across the emitter and base electrodes of the transistor. A series circuit including the primary winding 18, resistor 26 and emitter and collector electrodes are connected across terminals 24 and 14. An undirectional current flow element in the form of a diode 27 is connected across the base and emitter electrodes which in turn places it across a series circuit inclusive of resistor 25, feedback winding 19, and resistor 26. The output of the ion generator circuit is across the secondary winding 21 and designated as terminals 31 and 32 with terminal 32 being connected to ground. Terminal 31 is connected to the ionizing electrodes described hereinafter.

In the operation of ion generator circuit of FIG. 1 with particular reference to the waveforms A and B of FIG. 2, as the voltage applied to the transistor 17 is increased or goes positive, current begins to flow through the voltage divider resistors 23 and 25, primary winding 18 and feedback winding 19. A voltage divider action takes place and as the voltage across resistor 25 and feedback winding 19 applied to the base electrode reaches the turn-on voltage of the transistor 17, the transistor turns on and emitter electrode current starts to flow. The emitter electrode current passes through resistor 26 and primary winding 18. This current flow in primary winding 18 causes a voltage to be generated in feedback winding 19 which feeds back to the base electrode and saturates the transistor so that further increase of emitter electrode current has no effect.

As shown in FIG. 2, the voltage across the secondary winding 21 at terminals 31 and 32 having a full cycle designated B follows that of the primary winding 18, with a full cycle designated C, except the polarity is reversed. The voltage across the feedback winding 19 has the same waveform as the primary winding and a full cycle is designated D. Referring first to the primary winding 18, waveform designated C at first it is in the form of sharply rising positive pulse "*a*" with the feedback winding having a corresponding sharply rising positive pulse "*b*". The secondary winding 21 has corresponding, sharply dropping negative pulse "*c*".

When there is no flux in the transformer core 22 the current in the feedback winding 19 reduces to zero and the base-emitter electrode voltage designated E reduces until the transistor 17 is no longer at saturation. The collector electrode current of the transistor 17 then reduces which in turn reduces the current in the primary winding 18 and causes a collapse of the field in the core 22 causing an instantaneous reversal in the voltage across the primary winding 18 and this turns the transistor 17 off and drives the voltage in primary winding 18 to a greater negative voltage than was the positive voltage forming a negative flyback pulse in the primary winding 18 designated "*d*" with the feedback winding 19 having a corresponding negative pulse designated "*e*". This negative voltage remains across the primary winding 18 until the flux in the core has fully collapsed and starts to increase in the opposite direction. New flux lines then build up in a reverse direction in an oscillatory manner. When the new flux lines collapse, the voltage applied to the base of the transistor 17 through resistor 25 via feedback winding 19 turns on the transistor again completing the cycle of operation, the cycle repeats in a continuous manner with no appreciable time delay between the positive and negative going pulses or between successive cycles so the waveform has what is herein referred to as continuous oscillations of repetitive positive and negative pulses. In a like manner, the output waveform B is observed as having no appreciable time delay between pulses or between cycles and this increases ionization or the amount of available ions per volume of gas.

The diode 27 prevents the reverse base-emitter voltage of transistor 17 from exceeding the voltage-emitter-to-base (veb) rating of the transistor 17. The diode 27 thus acts as a clipper so that the base-emitter voltage never exceeds maximum voltage such as 1 volt.

In the illustrative embodiment shown the frequency of the electric energy of the oscillator portion applied to the transformer is about 3,000 Hz so that the time for a full cycle having a positive and negative output pulses "*c*" and "*f*" is about 0.3 milliseconds. The frequency of the envelope is about 120 cycles so that time for one half cycle of the line frequency waveform A is about 8.3 milliseconds. Therefore, as best seen by the composite waveform F at the output of the secondary winding 21 there are several cycles of oscillations in the transformer during each pulse of the full wave rectifier. The bridge rectifier circuit therefore forms an envelope repeating at a frequency of 120 Hz which limits the amplitude of the pulses and inside the envelope there are the pulses having a frequency of about 3,000 Hz. The envelope has been found to reduce the cost of the circuitry by eliminating components and reduces transformer noise. It is noted that for some applications the frequency may be changed by changing the turns on the transformer T-1. For the static bar the frequency may be as high as 20,000 Hz by reducing the turns of the primary winding 18.

It is noted that the voltages for the waveforms of FIG. 2 are designated V+ for the positive peak voltage and V− for the negative peak voltage. Typically, V+ for waveform B is about 4,400 volts and V− about 4,000 volts; V+ for waveform C is about 17 volts and V− about 21 volts; V+ for waveform D is about 10 volts and V− about 13 volts.

An alternative to resistor 16 in the circuit of FIG. 1 is a transistor voltage regulator circuit shown in FIG. 1A which is comprised of an NPN transistor 33, two resistors 34 and 35 connected in series between terminals 13 and 14 with the base and collector electrodes connected across resistor 34 and the emitter and collector between terminals 13 and 24. The regulator circuit of FIG. 1A permits the change in the amplitude of the output voltage of transformer 21 using the same transformer. A change in the value of resistor 34 changes the output voltage. Moreover, the regulator circuit protects the circuit so that the transistor 18 is not overloaded during a short circuit.

Referring now to FIG. 1B there is shown added circuitry associated with the secondary winding 21 inclusive of a resistor 36 in series therewith at terminal 31 and a diode 37 connected across the winding 21 and resistor with the resultant output being across diode 37. For one half of the cycle the diode 37 draws no current and the output pulse will be applied to the load. However, for the other half cycle diode 37 conducts and the voltage is dropped across resistor 36 with no pulse across the diode. The positive or negative portion of the waveform B may in this way be cut off so that ions of only one polarity are generated. This is particularly applicable to the spray painting application described hereinafter.

In an alternative form of circuit for the ion generator shown in FIG. 3, the input terminals 13 and 14 represented in FIG. 3 lead from the full wave bridge rectifier circuit 9 above described with reference to FIG. 1. This rectified voltage in turn is dropped across a line resistor 38. The oscillator portion of this ion generator circuit has a transformer T-2 with primary winding having a center tap so as to be divided into two windings designated 41 and 42 and a secondary winding 43 wound on a common core 44. The output terminals for the circuit at the ends of the secondary winding 43 are designated 45 and 46 with terminal 46 connected to ground. A capacitor 57 is shown connected across output terminals 45 and 46 has been found to increase the ionizing current particularly for the static bar application. Note this capacitor may also be used across terminals 31 and 32. The output terminal 45 is connected to the ionizing electrodes described hereinafter. The center tap of the primary winding is connected to the input line terminal 13 via resistor 38. Two NPN transistors 47 and 48 are connected in series with one another and across the primary winding and are connected so that the emitter electrodes are common and they in turn are connected to input terminal 14. The collector electrodes of the transistors 47 and 48 are connected to opposite ends of the primary windings 41 and 42. The base electrode of transistor 48 is connected via a resistor 49 to the collector electrode of transistor 47 connected to the end of winding 41. The base electrode of transistor 47 is connected via a resistor 50 to the collector electrode of transistor 48 connected to the end of winding 42.

In the operation of the circuit of FIG. 3 the output of transformer 43 is similar to that of transformer 21. When a positive voltage from the line is applied to the common emitters of transistors 47 and 48, transistor 48 turns on and takes control and current flows through winding 42 and the collector of the transister 48. In the circuit, terminals 13 is always positive with respect to terminal 14. As current flows through winding 42, a voltage is induced in winding 41 in a feedback action in such a manner as to increase the voltage across resistor 49 which increases the base electrode current of transistor 48 turning the transistor 48 on even harder until the transistor 48 saturates at which time full line voltage is applied across winding 42. This is coupled to the secondary winding 43 in the form of a negative output pulse similar to pulse "*c*" of FIG. 2. When the transformer T-2 has no changing current in its primary winding 42, the feedback voltage in winding 41 drops, reducing the current through resistor 49 and the base electrode of transistor 48. As soon as the current drops, the transistor 48 starts to turn off. Due to the second transistor 47 and the flyback effect of the transformer T-2, current is induced through the resistor 50 and the base-emitter junction of the transistor 47 which turns on and draws the collector current through winding 41 and the cycle begins again only this time there is a reverse in the output pulse in winding 43 causing a reverse pulse similar to the represented "*f*" in FIG. 2. The principal difference in operation of the circuit of FIG. 3 from that of FIG. 1 resides in the fact that the latter circuit adds energy from the power source applied to terminals 13 and 14 at the end of each pulse (180°) when one of the two transistors turns on and drives while the circuit of FIG. 1 adds energy from the power source at the end of each full cycle (360°).

The energy dispersing structure shown in FIGS. 4 and 5 with which the circuits above described are operatively associated comprises an outer tubular housing 51 made of an electric insulator material such as plastic shaped with an intermediate axially extending tubular portion 52, a rear end wall portion 53 and a front end wall portion 54, the housing 51 being split longitudinally into an upper section 52*a* and a lower section 52*b*, the upper section 52*a* having offset protruding edges 55 which overlap the edges of the lower section 52*b* so that the protruding edges of the upper section fits down over a portion of the lower section. The lower section also has a downwardly extending depressed section 57 in a lower central portion thereof.

A gas input fitting 61 with an internal axial flow passage 62 is mounted in the housing and has an externally threaded rear end portion 63 projecting through an opening in the rear end wall 53 of the housing and an externally threaded front end portion 64, the fitting 61 having a section of reduced size within the housing on which there is mounted the transformer T-1 connected in the electric circuit above described with reference to FIG. 1.

A generally tubular member 71 of an electric insulator material such as plastic has an internal axial passage forming an ion chamber 72 in the housing 51 in coaxial alinement with the gas input fitting 61, the ionizing chamber 72 being arranged in coaxial alinement and in flow communication with flow passage 62. The member 71 has an internally threaded, rear, axial bore section 73 of reduced size threading over the forward end portion 64 of the gas input fitting 61 and has an internally front bore section 75. A support ring 77 made of an electric conductive material is mounted in an inner recessed section of the tubular member 71 about flow passage 62 and supports three ionizing electrodes 78 arranged at circumferentially spaced 120° intervals around the outlet of the passage 62, the passage 62 being concentric with an imaginary circle containing the centers of electrodes 78. The gas ionizing structure also includes an arcuate ground electrode 79 in the form of a semi-circular shaped electrically conductive foil located and supported in the upper section 52*a* of the housing and extending around the upper portion of the ionizing chamber 72 in a concentric relation thereto. This location and shape of the ground electrodes 78 and extends upstream and downstream of the ionizing points. This arrangement produces an electric field with the lines of force in a vertical direction substantially normal to the direction of the flow of the stream of gas passing via fitting 61 in contrast to horizontal or axially directed lines in the passage of the ionizing apparatus shown in my earlier U.S. Pat. No. 3,878,469 and has resulted in a substantiated improvement in the amount of ionization being produced. For example, it was found that the output voltage of the circuit applied to the ionizing electrode could be reduced from about 12,000 volts peak to about 4,000 to 4,500 volts peak with increased ionization.

The light emitting diode lamp 11 is mounted in the housing to indicate when the electric power is on. The electric power for the devices comes in an electric conduct 82 up through a grommet 83 in an aperture in the lower housing section 52*b*.

A nozzle member 81 is mounted in a grommet 84 in an aperture in the front wall 54 with a portion of the nozzle member in a portion projecting forwardly beyond the housing. Nozzle member 81 has an axial through-passage with a washer-like member 85 fitted in a counter bore in the inlet end providing a central restricted inlet orifice 86 leading into a resonant cavity 87 of a larger diameter than the inlet orifice, the resonant cavity having a selected axial length to generate sound waves of a selected frequency. The resonant cavity has a central restricted outlet 88 the same diameter and in coaxial alinement with the inlet 86 leading into the nozzle passage. The size of the inlet orifice 86 is a function of the desired air volume at a particular inlet pressure and this inlet orifice 86 produces an expansion of the gases in the resonant cavity 87 which starts the supersonic waves or vibrations. The length of the resonant cavity is one half of wave length for an open-ended type air column so that for a frequency vibration of 30,000 cycles the length of the resonant cavity is about $\frac{1}{3}$ inches. The size of the outlet 88 is equal to that of the inlet orifice 86 for a continuous flow under pressure without a change of pressure in the resonant cavity 87. The resonant cavity 87 differs from the previous application in that it has only a single central outlet and inlet of the same size. The outlet section 89 of nozzle member 81 has a length of one half wave length or a multiple thereof in relation to the frequency of the resonant cavity so as not to interfere with the ultrasonic vibrations produced in the cavity 87 and/or to reinforce selected harmonics. The nozzle member 81 has radial holes 90 to provide gas flow in case of a plugging or stoppage at the outlet of the nozzle and internal threads 91 at the outlet end. The radial holes 90 are located at one half wave length or multiples thereof in relation to the resonant frequency of the resonant cavity so as not to interfere with the ultrasonic waves being generated. The provision of an outlet section 88 the same size as the outlet of the resonant cavity 87 facilitates cleaning and moves air at a higher velocity than if it is enlarged as described hereinafter. Printed circuit boards 92 for the electric components are supported on each side of the tubular member 71 inside the housing 51.

OPERATION

In the full sequence of operation of the apparatus of FIGS. 4 and 5 including the associated electric circuits, a stream of gas, usually air, under pressure is delivered via the inlet passage 62 past the ionizing electrode pins 78 in the ionizing chamber 72 where it is pulsed by the continuous, oscillatory positive and negative electric pulses being applied thereto. The alternating positive and negative pulses of electric energy generate ions of a positive polarity and then of a negative polarity. The stream of ionized gas passes through inlet 86 into the ionizing chamber 87 where the ions are accelerated to ultrasonic velocities and groups of ions of like polarity are present in pressure waves with positive and negative ions in discrete pockets or areas are produced as fully described in my U.S. Pat. No. 3,878,469 entitled "Method and Apparatus for Producing Ions at Ultrasonic Frequencies". The ionized stream of gas is then passed through the outlet section 88 of the nozzle member 81 to the point of use.

An ion generator gun of the type described using ultrasonic energy has been found to greatly enhance the propagation of ionization as a non-contact cleaning tool. The ultrasonic energy not only adds its own effect in removing a charge and particulate from surfaces but enhances the propagation of ionization through slots, tubing, duct work and the like. Prior known devices were not satisfactory for propagating ionization through slots etc. because of surface recombination.

It has also been found that the production of ions in the apparatus above described may be increased appreciably by heating the stream of gas (usually air) above the usual ambient temperatures. This may be done prior to, during or after ionization and may be done with or without the use of the ultrasonic sound wave generator provided by the resonant cavity 87.

In the embodiment shown in FIG. 4A, a heater is provided in the form of a tubular member 93 provided with a heater element 94 in the form of an electric resistor to which an electric potential is applied to heat the gases passing through member 93. This tubular member is suitably coupled to fitting 61 in FIG. 4 to heat the gas prior to entry into the ionizing chamber or to the outlet nozzle 81 to heat the ionized gas.

For heating during ionization there is shown a modified construction in tubular member 71 in FIG. 4B, wherein a layer of insulation 66 is provided in the ionizing chamber 72 and the heater element 94 is mounted therein to heat the gas during ionization.

Referring again the FIG. 1 the heating element 94 is shown as connected in the circuit in series with a thermal overload device 67, the series circuit being connected across input terminals 5 and 6. In this way, when the temperature of the gas moving through the ion chamber becomes excessive, the heat sensitive contacts 67 open, disconnecting the power to the heater and the heater 94 cools off until a preselected lower temperature is reached at which time the contacts of device 67 close and the power is applied to the heater element 94. This protects the ion generator device against excessive temperatures.

In an alternative circuit arrangement for the heater element shown in FIG. 6 the full line voltage 15 is applied across the heater element 94 but only a portion of the line voltage is applied to the bridge rectifier circuit 9 to produce ions by virtue of the use of the tap **94*a* which takes only a portion of the voltage across element 94. This has been found to reduce the cost of transistor 18** since a lower voltage transistor may be used.

In another circuit arrangement for the heater element which is shown in FIG. 1 and designated 94', an isolation transformer winding 68 is connected in series with the secondary winding 21 at terminal 31 and the heater element 94' is connected across isolation transformer winding 68. This arrangement makes the heating simultaneous and syncronized with ionization using for example the structure of FIG. 4B with the heater in the ionizing chamber.

In an automatic control for the heater shown in FIG. 7, a conventional Triac control member 69 is connected in series therewith and a conventional electric heat sensor 70 senses the temperature of the gas. The sensor 70 controls one of the electrodes of the Triac control member 69 as shown in FIG. 7. The Triac control member 69 functions to clip off a portion of the cycle of the AC power as represented by waveform P in FIG. 8 in relation to the temperature being sensed by sensor 70 and provides substantially constant heat for the stream of gas being conveyed through the ion chamber. There is further provided in the circuit of FIG. 7 a pressure sensitive relay comprised of a contact portion 76 connected between terminal 6 and fuse 8, which contact portion is opened and closed by a pressure control portion 77 coupled in the gas input line leading into the ion generator represented at 62 in FIG. 4. The pressure sensitive relay is set to close the relay portion when gas is flowing and open the circuit when gas is not flowing.

PLURAL ULTRASONIC GENERATORS

Referring now to FIG. 4, there is shown a nozzle member 95 having two cascaded ultrasonic generators in the form of resonant cavities 96 and 97 arranged one after the other in series so that the ionized gas stream passing from resonant cavity 96 is applied to the resonant cavity 97 with the output gas stream of resonant cavity 97 then passing into the discharge section 100 of the nozzle member 95. In this embodiment resonant cavity 96 is formed by a cup-like body 98 which inserts into the axial passage of the member 95 at the inlet end. The cup-like body 98 has a smaller inlet section 99 and a larger cavity section 101 formed therein in coaxial alinement with one another.

The resonant cavity 97 is formed by a similar cup-like body 102 and has a smaller inlet section 103 and a larger cavity section 104. The body 102 is inserted first into member 95 and fits against an inside flange 104 forming the outlet 107 of the second resonant cavity 97. A retaining ring 105 holds the cup-like bodies 98 and 102 in place in a nozzle member 95. The outlet section 100, of the nozzle member is enlarged relative to outlet 107 so that the ionized gases expand and has a plurality of radial holes 106. The expansion of the outlet passage has been found to amplify the lower frequency harmonics, for example 8,000 cycles.

The use of multiple ultrasonic cavities as shown in FIG. 9 are useful for either amplification of the energy of the base frequency of the first generator or for amplifying the energy of a selected harmonic of the base frequency. For example if resonant cavity 96 resonates at 24,000 Hz and resonant cavity 97 at 24,000 Hz then there is simply amplification or energy increase in the base frequency. However, if it is desirable to amplify the energy level of other selected harmonics for certain cleaning purposes then resonant cavity 97 may be constructed to resonate at 72,000 Hz and in this way amplify the third harmonic waves produced in the resonant cavity 96.

In another form of plural ultrasonic generator arrangement shown in FIG. 10, the ultrasonic sound wave energy is applied to the gas in two successive stages prior to ionization of the gas. An inner tubular member 11 made of an electric insulation material inside the housing 51 is coupled to a gas inlet fitting 112 and carries two cascaded cup-like bodies 113 and 114 forming successive ultrasonic resonant cavities 115 and 116, respectively, with successive outlets 117 and 118, respectively. An output nozzle member 121 threads into the downstream end of the tubular member 111 forming the downstream end wall of a cavity 122 downstream of the ultrasonic resonant cavities 115 and 116. Three ionizing electrode pins 123 on a conductive ring 124 are provided in the ionizing cavity 122 which has a restricted outlet 125 leading into an enlarged discharge section 127 of the output nozzle member 121. The electrode pins are at 120 degree intervals similar to electrodes 78 above described and terminate in ionizing points. Again radial holes 126 are provided in the nozzle member at a selected distance along the length thereof.

Another form of ion generator structure with internal gas heating shown in FIG. 11 has a tubular housing 131 shown as having a circular transverse cross-section with a counter bore 132 at each end in which there is provided at the gas inlet end an inlet fitting 133 having an enlarged disc-like portion fitted in the counter bore and at externally threaded end portion adapted to receive a pipe fitting to couple gas thereto. The fitting 133 has a gas flow passage 134 through which the gas stream enters and then expands into an inner enlarged chamber 135 inside housing 131. A helically wound heating coil 136 is wrapped on a ceramic core 137 which in turn is mounted on a central electrically conductive shaft 138 with core 137 and shaft 138 forming a hub extending axially through the central portion of the housing. The helical coil 136 has a plurality of turns each spaced from one another for additional heating of the gas. A pair of axially spaced end plates or discs 139 and 140 fit on the ends of the shaft and are held by nuts 141 preferably threading on the ends of the shaft 138. Upstream disc 139 has a plurality of circumferentially spaced inlet openings 142 spaced at equal intervals forming an inlet which pass the gas stream from chamber 135 around the coil 136 in a heating chamber 131*a* and disc 140 has a plurality of circumferentially spaced outlet openings 143 spaced at equal intervals forming an outlet to pass the heated gas from the heating chamber 131*a*. A layer of insulation 144 is provided along the inside of the housing between discs 139 and 140 and spaced outwardly of the coil 136 to heat insulate the housing 131. The ionizing chamber 145 is formed in the downstream end portion of the housing 131 beyond downstream plate 140. Three circumferentially spaced ionizing electrode pins 146 at 120° like that shown in FIG. 5 are supported on a conductive ring 147 on the shaft 138. A circular plate 155 extends along the inside of the housing 131 and encompasses the ionizing electrode pins forming the ground electrode. The ground electrode 155 extends both upstream and downstream of the ionizing pins. A layer of insulation 156 heat insulates the ionizing chamber 145. Shaft 138 is electrically conductive and carries current to conductive ring 147. The downstream end of the housing 131 has a disc 148 fitted in the counter bore at the outlet of the housing with a central restricted orifice 148*a* which forms the downstream end of the ionizing chamber 145. The nozzle member 149 at the outlet end of the housing has an enlarged cup-shaped portion which fits in the counter bore of the housing against disc 148 to form a resonant cavity 150 downstream of the ionizing chamber 145. A smaller diameter bore 151 in nozzle member 149 leading from the ultrasonic resonant cavity 150 and leads into enlarged outlet passage 152 having radial openings 153. The transformer T-1 and circuitry on plates 92 are supported on a suitable casing structure disposed below the housing 131. The resonant cavity 150 is considerably wider in radial extent than it is long and has been found to generate additional ultrasonic energy. The shortened nozzle member 149 has a passage 152 selected in length so as to eliminate lower or audio frequencies such as around 8,000 Hz and below. The modification shown in FIG. 11A includes a pipe section 157 on the inlet end of disc 148 making a passage 159 having a selected length in relation to the resonant frequency of the resonant cavity 150 to increase the energy level. A length of five times the diameter has been found highly effective.

A modified ion generator structure shown in FIG. 12 has a conductive ring 161 connected on shaft 138 and held by a nut 162 so that the ionizing pins 163 are carried by the upstream plate and are located inside the heating chamber 131*a*. In this way the gas stream passes between electric ground and the pins 163 and heating takes place substantially simultaneously with ionization. A ground electrode plate 159 is spaced outwardly of the ionizing electrode pin 163. The heated ions pass into an outlet chamber 165 and into the ultrasonic generator (not shown) like chamber 150 above described via outlet 148. The outlet chamber 165 is heat insulated by a layer of insulation 160.

Referring now to FIG. 13, there is shown a modified nozzle member 171 with a resonant cavity 172 formed at the inlet end and an enlarged nozzle outlet section 173. This nozzle member 171 may be used with or without the ultrasonic chamber 172 and is used where the gas is heated. The nozzle member 171 has circumferentially spaced outwardly enlarged venturi openings 173 characterized by increasing in diameter toward the outer end and inclined toward the upstream end. These venturi openings 174 draw additional gas into the gas stream and have been found effective in increasing the volume of gas thereby cooling the gas discharged from the nozzle member when the heating of the gas is used.

The ion generator apparatus shown in FIGS. 11 through 13 with the circuit of FIGS. 1 or 3 having the modification of FIG. 13 has particular application to electrostatic spray painting wherein a fluidizing bed with a fine powder is coupled by a line to the input fitting 134. The fluidizing bed has a pressure line from a compressor or like pressure source. The powder passes through input line and over the heating coil 136 to be heated and is ionized in chamber 145 with a single polarity pulse, ultrasonically pulsed with sound waves in chamber 150 and then directed by the nozzle member 149 to an object being sprayed which is connected at ground potential. In the spray gun application the heating coils 135 are preferably sealed so as not to contact the powder or like particles being sprayed.

Referring now to FIG. 14 there is illustrated schematically portions of the conventional internal combustion engine of a motor vehicle or the like in which a stream of air represented by arrows 201 is drawn into the air cleaner 202 and then through the induction pipe 203 which in turn is coupled to the intake side of the engine 204. The inside of the induction pipe is usually narrowed to a reduced diameter at an intermediate position to increase the velocity thereof and the pressure decreases to suck the fuel out of the carburetor 205 supplied by a tank represented at 206, with the fuel being atomized in the induction pipe 203. In the operation of the conventional engine, the tiny atomized droplets of fuel are carried along the intake portion of the engine by the air stream. As a result of the heat of absorption on the way to the cylinder, these droplets are vaporized and the vapor-air fuel mixture enters the combustion chamber 208 of the engine. The throttle valve 209 in the inlet pipe is operated by the accelerator pedal by the operator to regulate the fuel flow.

The distributor portion of a conventional internal combustion engine shown schematically in FIG. 14 includes contacts shown in the form of an electric switch 211 with an ignition cam 212 arranged to rotate as the engine rotates and open and close the contacts 211 in accordance with the ignition timing. A capacitor 213 is connected across the contacts 211 to prevent sparking. In this arrangement, the coil of the vehicle normally supplying spark for the spark plugs and represented at T-3 is used as the transformer to increase the electrical power for generating positive and negative ions. The coil T-3 has a primary winding 214 and two secondary windings designated 215 and 216 wound on a common core 217. Preferably, the vehicle battery designated 218 is utilized as the source of electric power. The battery voltage is applied to the contacts 211 via a resistor 221.

A control circuit is operatively coupled between the battery 218, contacts 211 and primary winding 216 to alternately couple and uncouple the power from the battery to the primary winding via the contacts 211. The control circuit includes a voltage divider comprised of resistor 222, potentiometer 223 and resistor 224 is connected across the battery 218. A transistor 225 has its collector and emitter electrodes connected between the output of the voltage divider and the collector electrode of a second transistor 226 to serve as a voltage regulator as it the circuit of FIG. 1A. The emitter electrode of transistor 226 is connected to the ungrounded side of the primary winding 214. The base electrode of transistor 225 is connected to a center tap on potentiometer 223 so that a change in the setting of the tap on potentiometer 223 varies the output voltage of the secondary winding. The base electrode of transistor 226 is connected between contacts 211 and resistor 221. In this way contacts 211 control the conduction of the transistor 226 and the energization of winding 214. As long as the contacts 211 are closed current flows in the primary winding 214 and a magnetic field is formed in the coil core 217. At the instant when the cam 212 interrupts the primary current by opening the contacts 211 this magnetic field breaks and the sudden change of the magnetic field induces a voltage in the secondary windings 215 and 216 which in normal engine operation produces a spark in the spark plugs of the vehicle. A double pole, double throw reversing switch 227 is coupled between the secondary winding 215 and the electrode assembly in air filter 202 to reverse the polarity of the pulses applied thereto.

Additional ignition timing of the engine is controlled by a negative pressure in the induction pipe 203 behind the throttle valve 209 which is normally transmitted by linkage to the contact-breaker plate inside the distributor. This linkage includes a tubular section 231 opening into the induction pipe 203, a diaphram 232 connected to a linkage bar 233 and a diaphram spring 234 biasing the diaphram in one direction. The linkage bar 233 is coupled to the movable tap on potentiometer 223 via a conventional linear-to rotary motion converter 235 coupled to the movable tap so that as the ignition timing is altered there is a change in the setting of the tap on potentiometer 223.

Figure 15:
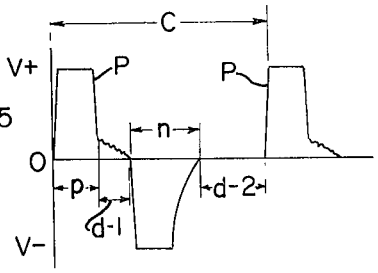
FIG. 15 is an illustration of the waveform produced in the secondary winding of the coil shown in FIG. 14.

In the operation of the circuit of FIG. 14 and with reference to the waveform of FIG. 15, when contacts 211 are open transistor 226 turns on and current flows in winding 214 producing a positive pulse P. When the contacts close there is some time delay d-1 before the positive pulse reaches zero and then there is a negative flyback pulse N for a time duration designated "*n*". When contacts 211 are again opened there is another time delay d-2 before another positive pulse P appears followed by a negative pulse N. Each positive pulse and negative pulse produces positive and negative ions in the air stream passing through the air filter 202 and in the exhaust gases at the manifold 246 by its application to one or more ionizing electrodes as described hereafter.

It is understood that while the coil of the vehicle affords a convenient generator for producing periodic oscillatory pulses of electric energy, that the circuits of FIGS. 1 through 8 may also be used to apply the pulses generated therein to the electrode assemblies in the air cleaner or in the exhaust system.

Figure 16:
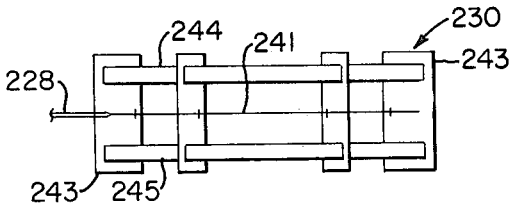
FIG. 16 is a side elevation view of an ionizing electrode assembly adapted to be placed in the air filter in the engine of the system of FIG. 14.
Figure 17:
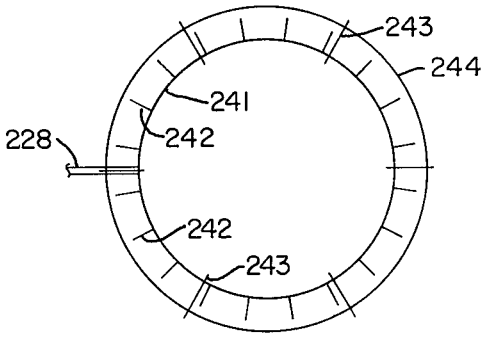
FIG. 17 is a top plan view of the ionizing electrode assembly of FIG. 16.

The ionizing electrode assembly 240 contained in the air filter 202 is shown in detail in FIGS. 16 and 17 includes a high voltage conductive metal ring 241 with a plurality of ionizing electrode pins 242 secured at equally spaced intervals around the periphery of the ring 241. The output of the secondary winding 215 is coupled to the inner ring 231 via a line 228 to convey the ionizing power to the ionizing points. The ring 241 passes through a plurality of upright support spacers 243 made of a non-conductive material arranged along the middle of the inner side edges thereof. Upper and lower metal ground plates 244 and 245 pass through the support spacers at the outer side edges. As best seen in FIG. 16, there are six spacers 243 at about 60 degree intervals and twenty ionizing pins 242 arranged at eighteen degree intervals. This places the ionizing points midway between the upper and lower ground plates 244 and 245. In operation, the ionizing assembly is placed inside the center of the air filter of the vehicle so that the incoming air passing into the induction pipe 203 passes through an electric field between the ionizing points and ground plates and is ionized.

Figure 18:
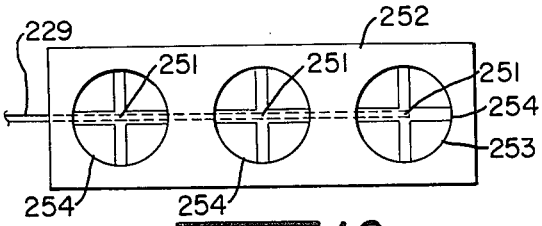
FIG. 18 is a side elevation view of an ionizing electrode assembly adapted to be placed across the manifold of an engine in the system of FIG. 14.
Figure 19:
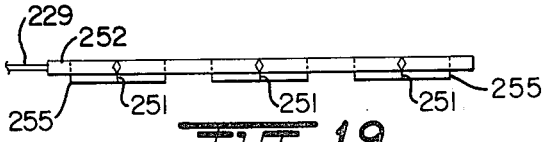
FIG. 19 is a top plan view of an ionizing electrode assembly of FIG. 18.
Figure 20:
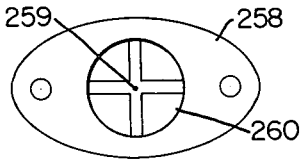
FIG. 20 is a side elevation view of an ionizing electrode assembly used in the system of FIG. 14 adapted to be placed across the exhaust pipe leading from the manifold.
Figure 21:
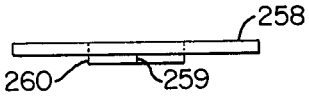
FIG. 21 is a top plan view of the ionizing electrode assembly of FIG. 20.

The exhaust manifold represented diagrammatically at 246 in FIG. 14 is provided with one or more ionizing pins 251 in the exhaust manifold for the purpose of breaking up the hydrocarbons, nitrons oxide products and promote the formation of water, oil, and carbon dioxide. To this end the ionizing electrode pins 251 shown are mounted on a manifold gasket 252 shown in detail in FIGS. 18 and 19. The manifold gasket has openings with a cross-shaped central section 254 on which there is mounted an ionizing pin 251. A power supply line connects to each of the pins to carry the current from the secondary winding of the coil. A ground electrode ring 255 surrounds or encircles each of the ionizing electrode pins and fits into the head or block of the engine in a frictional engagement therewith to ground the electrode ring or the head or block itself may be directly used as the ground.

An alternative to the locations of several ionizing points at the ports of the exhaust manifold is to provide an exhaust gasket 258 at the end of the manifold where it connects to the tailpipe with a cross-section over the port and a single ionizing electrode pin 259 with a surrounding ground electrode ring 260.

Although the present invention has been described with a certain degree of particularity, it is understood that the present disclosure has been made by way of example and that changes in details of structure may be made without departing from the spirit thereof.

What is claimed is:

1. In apparatus for improving the operation of an internal combustion engine having an exhaust system inclusive of a manifold and an exhaust pipe for discharging the products of combustion, an ignition system including contacts and an ignition cam that opens and closes the contacts as the engine is rotated, and a coil for producing a spark in a combustion chamber including a primary winding and a secondary winding wound on a common core, and a power source on the vehicle for providing electric power to the coil, the combination comprising:

control circuit means coupled between the power source and primary winding of the coil to alternately couple and uncouple the electric power to the primary winding to produce continuous oscillations of repetitive positive and negative pulses of electric energy at a voltage sufficiently low to avoid the production of ozone, said control circuit means having a voltage divider including a potentiometer having a tap, said potentiometer being connected across said battery, a first transistor and a second transistor each having emitter base and collector electrodes, said first transistor and second transistor being cascaded between the voltage divider and the primary winding, the base of the first transistor being connected to a tap on a potentiometer in the voltage divider and the base electrode of the second transistor being connected to the contacts whereby to alternately open and close the contacts to conduction and non-conduction of the transistors, and an ionizing electrode assembly in proximity to the exhaust gases including at least one ionizing electrode coupled to the secondary winding together with a ground electrode spaced from the ionizing electrode for applying said electric energy to the exhaust gases to generate ions in the stream of exhaust gases substantially free of ozone to break up the products of combustion.

2. In apparatus as set forth in claim 1 wherein said ionizing electrode is centered in a port in the exhaust manifold.

3. In apparatus as set forth in claim 1 wherein said ionizing electrode is centered in the exhaust pipe.

4. In apparatus for improving the operation of an internal combustion engine having an exhaust system including a manifold and an air cleaner associated with an induction pipe into which air is drawn to produce combustion in the combustion chamber, an ignition system including contacts and an ignition cam that opens and closes the contacts as the engine is rotated, a coil for producing a spark in the combustion chamber including a primary winding and a secondary winding wound on a common core, and a power source for providing electric power to the coil, the combination comprising:

control circuit means coupled between the power source, contacts and primary winding of the coil to alternately couple and uncouple the electric power to the primary winding via said contacts to produce continuous oscillations of repetitive positive and negative pulses of electric energy at a voltage sufficiently low to avoid the production of ozone, said control circuit means having a voltage divider including a potentiometer having a tap, said potentiometer being connected across said battery, a first transistor and a second transistor each having emitter base and collector electrodes, said first transistor and second transistor being cascaded between the voltage divider and the primary winding, the base of the first transistor being connected to a tap on a potentiometer in the voltage divider and the base electrode of the second transistor being connected to the contacts whereby to alternately open and close the contacts to conduction and nonconduction of the transistors;

an electrode assembly in the air cleaner in proximity to the air stream drawn into the induction tube including at least one ionizing electrode coupled to the secondary winding together with a ground electrode spaced from the ionizing electrode for applying said pulses of electric energy to the air stream into the induction pipe to ionize said air stream with a minimum of ozone prior to combustion of the fuel, said electrode assembly including a conductive ionizing ring connected to the secondary winding having a plurality of pin-like ionizing electrodes at spaced intervals around the ring and radiating outwardly from the ring, an upper conductive ground ring spaced above said ionizing ring and a lower conductive ground ring spaced below said ionizing ring;

a plurality of upright support spacers made of a nonconductive material for supporting said ionizing ring and said upper and lower ground rings in vertically spaced relation to one another in the air cleaner; and a reversing switch between said secondary winding and said electrode assembly to change the polarity of the ions.

5. In apparatus as set forth in claim 4 further including a second secondary winding on said core and a second electrode assembly in proximity to the exhaust gases of the engine, said second electrode assembly including a second ionizing electrode coupled to said second secondary winding and a second ground electrode spaced from said second ionizing electrode.

6. In apparatus as set forth in claim 5 wherein said second ionizing electrode in a pin-like conductive member located in the exhaust manifold.

7. In apparatus as set forth in claim 5 wherein said second ionizing electrode is a pin-like conductive member located in the exhaust pipe.

* * * * *